US008471804B2

(12) United States Patent
Wu et al.

(10) Patent No.: US 8,471,804 B2
(45) Date of Patent: Jun. 25, 2013

(54) CONTROL SIGNAL GENERATION METHOD OF INTEGRATED GATE DRIVER CIRCUIT, INTEGRATED GATE DRIVER CIRCUIT AND LIQUID CRYSTAL DISPLAY DEVICE

(75) Inventors: Meng-Ju Wu, Hsin-Chu (TW); Sheng-Kai Hsu, Hsin-Chu (TW); Yung-Tse Cheng, Hsin-Chu (TW); Ming-Hung Tu, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 1158 days.

(21) Appl. No.: 12/391,451

(22) Filed: Feb. 24, 2009

(65) Prior Publication Data

US 2010/0053060 A1 Mar. 4, 2010

(30) Foreign Application Priority Data

Aug. 27, 2008 (TW) ..... 97132775 A

(51) Int. Cl.
*G09G 3/36* (2006.01)

(52) U.S. Cl.
USPC ..... 345/99; 345/100; 345/98

(58) Field of Classification Search
USPC ..... 345/68, 84, 102, 690, 98, 100, 204
See application file for complete search history.

(56) References Cited

U.S. PATENT DOCUMENTS

| | | | | |
|---|---|---|---|---|
| 6,061,046 | A * | 5/2000 | An | 345/98 |
| 7,256,858 | B2 | 8/2007 | Yun et al. | |
| 2005/0156855 | A1* | 7/2005 | Jang et al. | 345/100 |
| 2006/0077197 | A1* | 4/2006 | Lin | 345/204 |
| 2006/0109229 | A1* | 5/2006 | Iwabuchi | 345/98 |
| 2007/0085812 | A1* | 4/2007 | O. et al. | 345/100 |
| 2007/0195055 | A1* | 8/2007 | Kim | 345/100 |

* cited by examiner

*Primary Examiner* — Quan-Zhen Wang
*Assistant Examiner* — Troy Dalrymple
(74) *Attorney, Agent, or Firm* — WPAT, PC; Justin King

(57) ABSTRACT

A control signal generation method of integrated gate driver circuit includes the steps of: providing one gate control signal to an integrated gate driver circuit; and generating a plurality of internal control signals by the integrated gate driver circuit according to on the gate control signal to control internal operations of the integrated gate driver circuit. Furthermore, an integrated gate driver circuit is adapted to receive one external gate control signal. The integrated gate driver circuit includes an internal control signal generation circuit for generating a plurality of internal control signals according to the external gate control signal to control internal operations of the integrated gate driver circuit. In addition, a liquid crystal display device using the above-mentioned integrated gate driver circuit also is provided.

11 Claims, 4 Drawing Sheets

CONTROL SIGNAL GENERATION METHOD OF INTEGRATED GATE DRIVER CIRCUIT, INTEGRATED GATE DRIVER CIRCUIT AND LIQUID CRYSTAL DISPLAY DEVICE

CROSS-REFERENCE TO RELATED APPLICATIONS

This application is based upon and claims the benefit of priority from the prior Taiwanese Patent Application No. 097132775, filed Aug. 27, 2008, the entire contents of which are incorporated herein by reference.

BACKGROUND

1. Technical Field

The present invention generally relates to liquid crystal display field and, particularly to a control signal generation method of an integrated gate driver circuit, an integrated gate driver circuit and a liquid crystal display device.

2. Description of the Related Art

Liquid crystal display (LCD) devices have become more and more popular in computer monitors or TVs for their light weight, flatness and low radiation, compared with the CRT monitor. A typical LCD device includes a glass substrate, a plurality of integrated source driver circuits, at least one integrated gate driver circuit, a printed circuit board and at least one flexible printed circuit board. The integrated source driver circuits and the at least one integrated gate driver circuit all are disposed on the glass substrate and electrically coupled to the printed circuit board via the at least one flexible printed circuit board. The printed circuit board has a timing controller formed thereon for outputting a plurality of control signals to the integrated source driver circuits and the at least one integrated gate driver circuit through the at least one flexible printed circuit board.

With the functions of integrated driver circuits are getting more and more, required amount of external input pins for the input of external signals increases. Accordingly, how to effectively make use of external input signals has been become an important topic.

With regard to the integrated source driver circuits, they usually use different analog signals transmitted from the printed circuit board. Furthermore, since functional requirements of the integrated source driver circuits, more input pins are needed to provide required input signals. For example, when the amount of gamma voltages increases or two different gamma voltages are needed, more input pins are needed to provide the input of signals.

In regard to the at least one integrated gate driver circuit, the primary function thereof is to serve as switches of thin film transistors and thus has less special requirement compared with the integrated source driver circuits. Furthermore, some control signals for the at least one integrated gate driver circuit generally are similar, so that it is possible to decrease the amount of input pins of the at least one integrated gate driver circuit and thus a revision cost resulting from the potential increase of the amount of input pins can be saved.

BRIEF SUMMARY

The present invention relates to a control signal generation method of an integrated gate driver circuit which can reduce the amount of input pins of the integrated gate driver circuit and thus the revision cost resulting from the potential increase of the amount of input pins can be saved.

The present invention further relates to an integrated gate driver circuit by which the amount of input pins required relatively become less so that the revision cost resulting from the potential increase of the amount of input pins can be saved.

The present invention still further relates to a liquid crystal display device of which an integrated gate driver circuit requires less input pins so that the revision cost resulting from the potential increase of the amount of input pins can be saved.

In order to achieve the above-mentioned advantages, a control signal generation method of an integrated gate driver circuit in accordance with an embodiment of the present invention is provided. The control signal generation method comprises: providing one gate control signal to the integrated gate driver circuit; and generating a plurality of internal control signals according to the gate control signal by the integrated gate driver circuit to control internal operations of the integrated gate driver circuit.

In one embodiment, the step of generating a plurality of internal control signals according to the gate control signal by the integrated gate driver circuit to control the internal operations of the integrated gate driver circuit comprises: performing an internal delay operation applied to the gate control signal to generate a delayed gate control signal; performing an inverting operation applied to the delayed gate control signal to generate a first internal control signal; performing a low pass filter operation applied to the delayed gate control signal to generate a second internal control signal; and performing a XOR logical operation applied to the delayed gate control signal and the second internal control signal to generate a third internal control signal. Furthermore, the first, second and third internal control signals can be an internal gate output enable signal INTERNAL OE, an internal gate start signal INTERNAL DIO_IN and an internal shift clock signal SF_CLK, respectively.

In one embodiment, the integrated gate driver circuit is adapted to sequentially drive N (N>1) gate lines, and the control signal generation method further comprises: generating one external control signal according to a Nth gate pulse signal and a special internal control signal (preferably, the internal shift clock signal SF_CLK) of the internal control signals by the integrated gate driver circuit, wherein the external control signal is adapted to serve as one gate control signal of another integrated gate driver circuit electrically coupled to the integrated gate driver circuit in cascade. Furthermore, the step of generating one external control signal according to the Nth gate pulse signal and the special internal control signal by the integrated gate driver circuit can comprise: using a falling edge of the special internal control signal as trigger and performing a data latch operation applied to the Nth gate pulse signal to generate a start signal DIO_OUT; and performing an OR logical operation applied to the special internal control signal and the start signal DIO_OUT to generate the external control signal.

An integrated gate driver circuit in accordance with another embodiment of the present invention is provided. The integrated gate driver circuit is adapted to receive one external gate control signal and comprises an internal control signal generation circuit, the internal control signal generation circuit is for generating a plurality of internal control signals according to the external gate control signal to control internal operations of the integrated gate driver circuit.

In one embodiment, the internal control signal generation circuit comprises a delay circuit, an inverter circuit, a low pass filter circuit and a XOR logical gate. The delay circuit has a first input terminal and a first output terminal, the first input terminal is coupled to receive the external gate control signal. The inverter circuit has a second input terminal and a second output terminal, the second input terminal is electrically coupled to the first output terminal, the second output terminal is for outputting a first internal control signal. The low pass filter circuit has a third input terminal and a third output terminal, the third input terminal is electrically coupled to the first output terminal, the third output terminal is for outputting a second internal control signal. The XOR logical gate has two fourth input terminals and a fourth output terminal, the fourth input terminals respectively are electrically coupled to the first output terminal and the third output terminal, the fourth output terminal is for outputting a third internal control signal.

In one embodiment, the integrated gate driver circuit further comprises a gate pulse signal generation circuit and an external control signal generation circuit; the gate pulse signal generation circuit is for sequentially generating N (N>1) gate pulse signals subject to the control of at least a part of the internal control signals (e.g., the internal gate output enable signal INTERNAL OE, the internal gate start signal INTERNAL DIO_IN and the internal shift clock signal SF_CLK); the external control signal generation circuit is for generating one external control signal according to the Nth pulse signal and a special internal control signal (preferably, the internal shift clock signal SF_CLK) of the internal control signals, the external control signal is adapted to serve as one external gate control signal of another integrated gate driver circuit electrically coupled to the integrated gate driver circuit in cascade. Furthermore, the external control signal generation circuit can comprise a data latch and an OR logical gate; the data latch has a fifth input terminal, a control terminal and a fifth output terminal, the fifth input terminal is coupled to receive the Nth gate pulse signal, the control terminal is coupled to receive the special internal control signal; the OR logical gate has two sixth input terminals and a sixth output terminal, the sixth input terminals respectively are electrically coupled to the fifth output terminal and the control terminal, the sixth output terminal is for outputting the external control signal.

A liquid crystal display device in accordance with still another embodiment of the present invention is provided. The liquid crystal display device comprises a first integrated gate driver circuit and a second integrated gate driver circuit electrically coupled to the first integrated gate driver circuit in cascade. The first integrated gate driver circuit is adapted to receive one external gate control signal and includes an internal control signal generation circuit, a gate pulse signal generation circuit and an external control signal generation circuit. The internal control signal generation circuit is for generating a plurality of internal control signals according to the external gate control signal to control internal operations of the first integrated gate driver circuit. The internal control signal generation circuit is for sequentially generating N (N>1) gate pulse signals subject to the control of at least a part of the internal control signals. The external control signal generation circuit is for generating one external control signal according to the Nth gate pulse signal and a special internal control signal (preferably, the internal shift clock signal SF_CLK) of the internal control signals, the external control signal is adapted to be input into the second integrated gate driver circuit as one external gate control signal of the second integrated gate driver circuit.

In one embodiment, the liquid crystal display device further comprises a plurality of integrated source driver circuits one of which is selected to output the external gate control signal to the first integrated gate driver circuit.

In one embodiment, the liquid crystal display device further comprises a timing controller adapted to output the external gate control signal to the first integrated gate driver circuit.

Compared with the prior art, in the embodiments in accordance with the present invention, only one gate control signal is inputted into an integrated gate driver circuit and then a plurality of internal control signals would be generated according to the inputted gate control signal by internal circuits of the integrated gate driver circuit to carry out the control of internal operations of the integrated gate driver circuit. Consequently, the amount of input pins of the integrated gate driver circuit will be reduced and the saved input pins can be used in other aspects. As a result, the revision cost caused by additional functional requirements incurring potential increase of input pins can be saved.

BRIEF DESCRIPTION OF THE DRAWINGS

The various embodiments disclosed herein will be better understood with respect to the following description and drawings, in which like numbers refer to like parts throughout, and in which.

DETAILED DESCRIPTION

Figure 1:
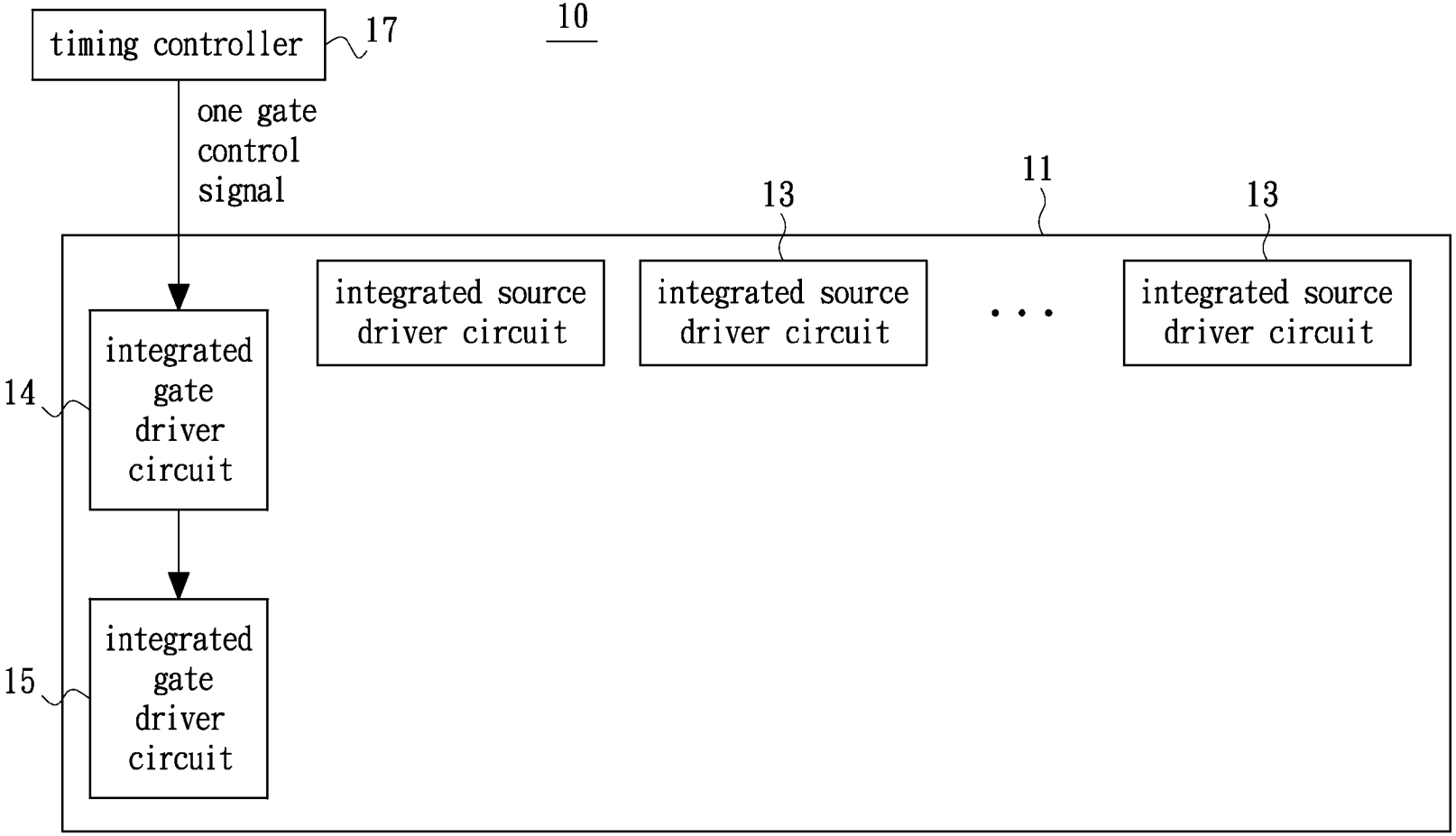
FIG. 1 is structural view of a liquid crystal display device in accordance with an embodiment of the present invention.

Referring to FIG. 1, a liquid crystal display device 10 in accordance with an embodiment of the present invention includes a substrate 11, a plurality of integrated source driver circuits 13, integrated gate driver circuits 14, 15 and a timing controller 17, for instance, not limit the number of driver circuits. The substrate 11 can be a glass substrate. The integrated source driver circuits 13 and the integrated gate driver circuits 14, 15 all are disposed on the substrate 11, for example, the integrated source driver circuits 13 and the integrated gate driver circuits 14, 15 all are directly formed on the substrate 11 with the formation of pixels of the liquid crystal display device 10. Alternatively, the integrated source driver circuits 13 and the integrated gate driver circuits 14, 15 all can be mounted on the substrate 11 in a manner of IC chip. Each of the integrated source driver circuits 13 is for providing image data to a plurality of data lines (not shown in FIG. 1) electrically coupled thereto and formed on the substrate 11. The integrated gate driver circuits 14, 15 are electrically coupled to each other in cascade. The integrated gate driver circuits 14, 15 are respectively for sequentially supplying gate pulse signals to a plurality of gate lines (not shown in FIG. 1) which are electrically coupled thereto and formed on the substrate 11, so as to switch on thin film transistors (not shown in FIG. 1) electrically connected to the respective gate lines.

The timing controller 17 provides one gate control signal to the integrated gate driver circuit 14. The integrated gate driver circuit 14 receives the gate control signal and generates a plurality of internal control signals and one external control signal according to the inputted gate control signal by internal circuit operations. The internal control signals are for controlling internal operations of the integrated gate driver circuit 14. The external control signal outputs to the integrated gate driver circuit 15 as one external gate control signal of the integrated gate driver circuit 15.

Figure 2:
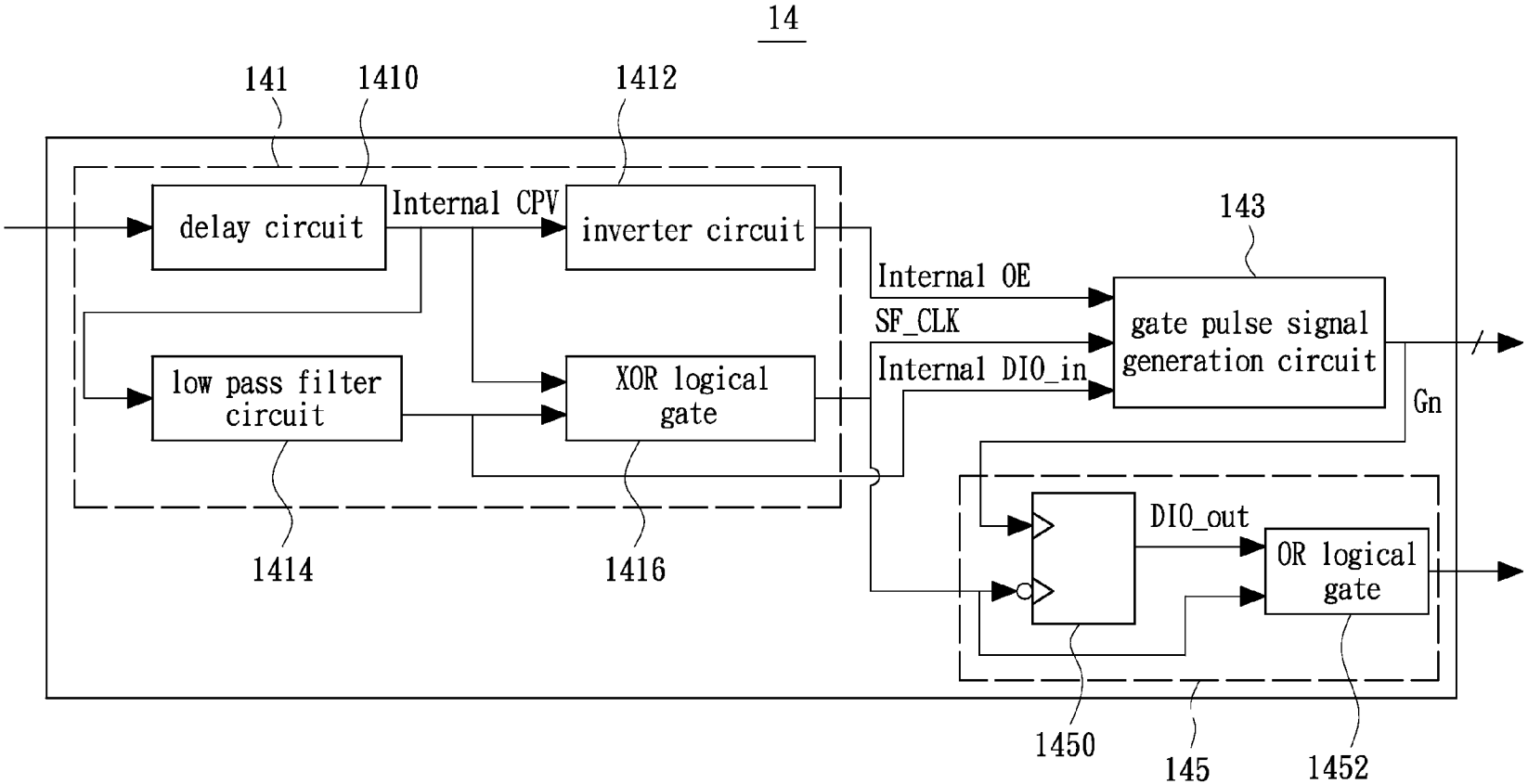
FIG. 2 is a circuit block diagram of an integrated gate driver circuit in accordance with an embodiment of the present invention.

Referring to FIG. 2, a circuit block diagram of the integrated gate driver circuit 14 is shown. The integrated gate driver circuit 14 includes an internal control signal generation circuit 141, a gate pulse signal generation circuit 143 and an external control signal generation circuit 145.

The internal control signal generation circuit 141 includes a delay circuit 1410, an inverter circuit 1412, a low pass filter circuit 1414 and a XOR logical gate 1416. An input terminal of the delay circuit 1410 receives the gate control signal provided by the timing controller 17, an output terminal of the delay circuit 1410 outputs an internal clock pulse signal INTERNAL CPV, i.e., delayed gate control signal. An input terminal of the inverter circuit 1412 is electrically coupled to the output terminal of the delay circuit 1410, an output terminal of the inverter circuit 1412 outputs an internal gate output enable signal INTERNAL OE. An input terminal of the low pass filter circuit 1414 is electrically coupled to the output terminal of the delay circuit 1410, an output terminal of the low pass filter circuit 1414 outputs an internal gate start signal INTERNAL DIO_IN. Two input terminals of the XOR logical gate 1416 respectively are electrically coupled to the output terminal of the delay circuit 1410 and the output terminal of the low pass filter circuit 1414, an output terminal of the XOR logical gate 1416 outputs an internal shift clock pulse signal SF_CLK. The internal gate start signal INTERNAL DIO_IN, the internal shift clock pulse signal SF_CLK and the internal gate output enable signal INTERNAL OE are for controlling the internal operations of the integrated gate driver circuit 14. In particular, the internal gate start signal INTERNAL DIO_IN is for representing the start of a frame, the internal shift clock pulse signal SF_CLK for enabling a gate line, and the internal gate output enable signal INTERNAL OE is for delaying or preceding the enable time of the gate line.

The gate pulse signal generation circuit 143 is for sequentially generating N (N>1) gate pulse signals subject to the control of the internal gate start signal INTERNAL DIO_IN, the internal shift clock pulse signal SF_CLK and the internal gate output enable signal INTERNAL OE, so as to sequentially drive N gate lines electrically coupled to the integrated gate driver circuit 14. The gate pulse signal generation circuit 143 generally includes a shift register and other relevant circuits such as a level shifter.

The external control signal generation circuit 145 includes a data latch 1450 and an OR logical gate 1452. An input terminal of the data latch 1450 is coupled to receive the Nth gate pulse signal generated from the gate pulse signal generation circuit 143, a control terminal of the data latch 1450 is coupled to receive the internal shift clock pulse signal SF_CLK generated from the internal control signal generation circuit 141 and uses a falling edge of the shift clock pulse signal SF_CLK as trigger, and an output terminal of the data latch 1450 outputs a start signal DIO_OUT. Two input terminals of the OR logical gate 1452 respectively are electrically coupled to the output terminal of the data latch 1450 and the output terminal of the XOR logical gate 1416, and an output terminal of the OR logical gate outputs one external control signal to the integrated gate driver circuit 15 as one external gate control signal of the integrated gate driver circuit 15.

Figure 3:
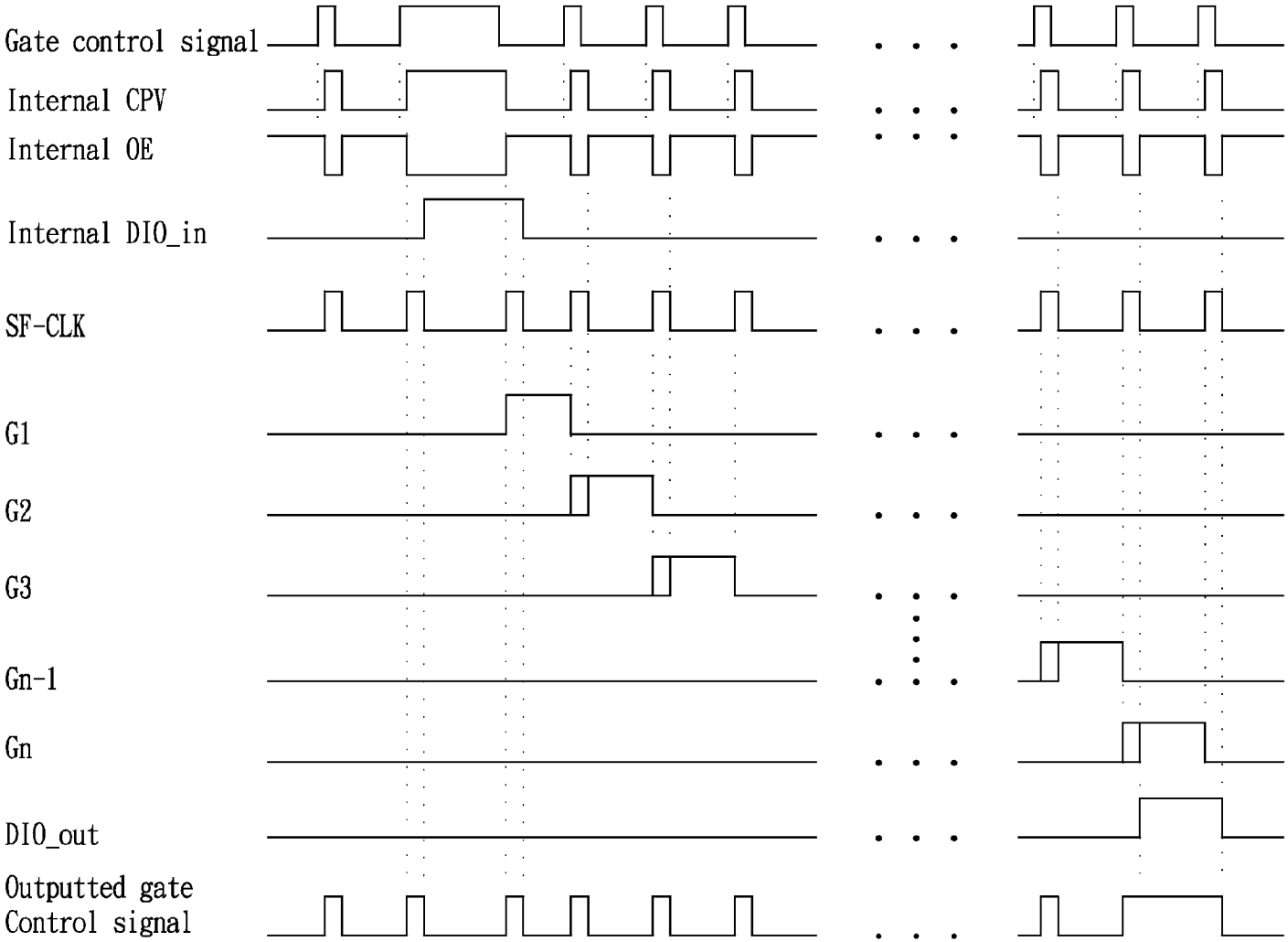
FIG. 3 shows timing diagrams of signals generated from internal circuits of the integrated gate driver circuit of FIG. 2.

Referring to FIG. 3, timing diagrams of signals generated from internal circuits of the integrated gate driver circuit 14 are shown. A control signal generation method of the integrated gate driver circuit 14 in accordance with an embodiment of the present invention will be described below in detailed with reference to FIG. 3. The control signal generation method includes steps (1) thought (3).

Step (1): one gate control signal is provided to the integrated gate driver circuit 14. The gate control signal can be provided by the timing controller 17.

Step (2): a plurality of internal control signals are generated according to the gate control signal by the integrated gate driver circuit 14, to control internal operations of the integrated gate driver circuit 14. In particular, the step (2) actually is a result of following several sub-steps. An internal delay operation applied to the gate control signal which is inputted into the integrated gate driver circuit 14 is performed by the delay circuit 1410 of the internal control signal generation circuit 141 of the integrated gate driver circuit 14, so as to generate an internal clock pulse signal INTERNAL CPV (i.e., delayed gate control signal). An inverting operation applied to the internal clock pulse signal INTERNAL CPV is performed by the inverter circuit 1412, so as to generate an internal gate output enable signal INTERNAL OE of the internal control signals. An low pass filter operation applied to the internal clock pulse signal INTERNAL CPV is performed by the low pass filter circuit 1414 where high frequency components are filtered out as noise and low frequency components are remained, so as to generate an internal gate start signal INTERNAL DIO_IN of the internal control signals. The internal clock pulse signal INTERNAL CPV and the internal gate start signal INTERNAL DIO_IN are applied to the XOR logical gate 1416 to perform a XOR logical operation, so as to generate an internal shift clock pulse signal SF_CLK of the internal control signals.

After the internal gate output enable signal INTERNAL OE, the internal gate start signal INTERNAL DIO_IN and the internal shift clock pulse signal SF_CLK generated by the internal control signal generation circuit 141 are inputted into the gate pulse signal generation circuit 143, when the internal gate start signal INTERNAL DIO_IN is logic high and a rising edge of the internal shift clock pulse signal SF_CLK comes, the gate pulse signal generation circuit 143 starts to sequentially generate N gate pulse signals $G_1, G_2, G_3, \ldots, G_{N-1}, G_N$ so as to sequentially drive N gate lines. The generations of the N gate pulse signals $G_1, G_2, G_3, \ldots, G_{N-1}, G_N$ use rising edges of the internal shift clock pulse signal SF_CLK as trigger. The internal gate output enable signal INTERNAL OE delays the generations of the N gate pulse signals $G_1, G_2, G_3, \ldots, G_{N-1}, G_N$.

Step (3): one external control signal (i.e., outputted gate control signal shown in FIG. 3) is generated by the integrated gate driver circuit 14 according to the internal shift clock pulse signal SF_CLK of the internal control signals and the Nth gate pulse signal $G_N$. The external control signal is adapted to serve as one gate control signal of the integrated gate driver circuit 15 electrically coupled to the integrated gate driver circuit 14 in cascade. In particular, the step (3) includes the following sub-steps. A falling edge of the internal shift clock signal SF_CLK is used as trigger and a data latch operation applied to the Nth gate pulse signal $G_N$ is performed to generate a start signal DIO_OUT. An OR logical operation applied to the internal shift clock pulse signal SF_CLK and the start signal DIO_OUT is performed to generate the external control signal.

It is indicated that the integrated gate driver circuit 15 in the above-mentioned embodiment can have the same circuit configuration with the integrated gate driver circuit 14. Correspondingly, a control signal generation method of the integrated gate driver circuit 15 is same as the above-mentioned control signal generation method of the integrated gate driver circuit 14 and thus will not be repeated herein. It is understood that, the integrated gate driver circuit 15 may have a circuit configuration different from that of the integrated gate driver circuit 14, for example, the integrated gate driver circuit 15 does not have the external control signal generation circuit 145 like the integrated gate driver circuit 14, and thus the step (3) of the control signal generation method of the integrated gate driver circuit 15 correspondingly is omitted. In addition, when the liquid crystal display device 10 in accordance with the above-mentioned embodiment only needs one integrated gate driver circuit, the integrated gate driver circuit has no need to be equipped with the external control signal generation circuit 145 like integrated gate driver circuit 14.

Figure 4:
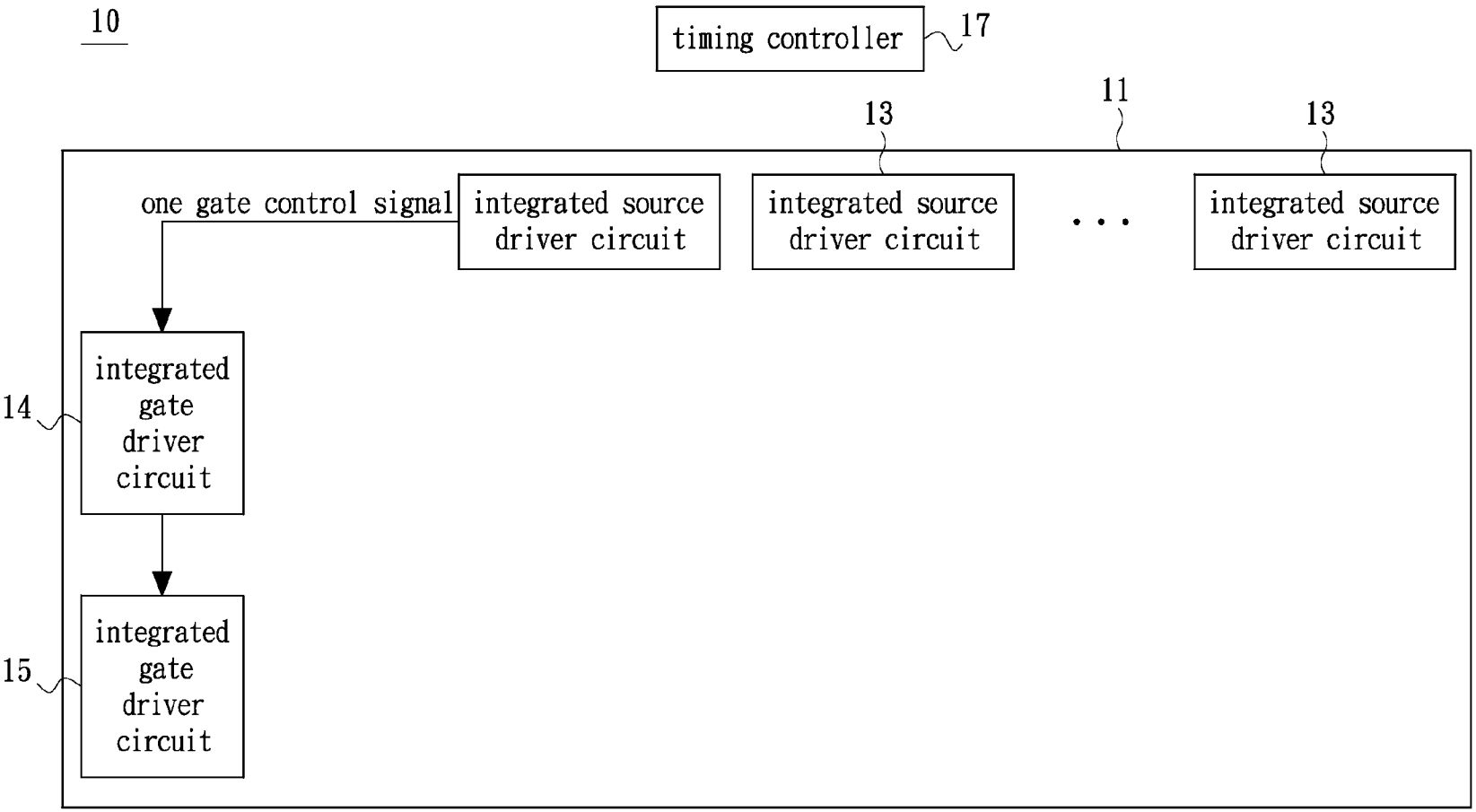
FIG. 4 is a structural view of a liquid crystal display device in accordance with another embodiment of the present invention.

Additionally, the gate control signal inputted into the integrated gate driver circuit 14 is not limited to be provided by the timing controller 17. Referring to FIG. 4, the gate control signal can be provided by a selected one (e.g., the integrated source driver circuit 13 immediately proximal to the integrated gate driver circuit 14) of the integrated source driver circuits 13 instead. In the case that the gate control signal is provided to the integrated gate driver circuit 14 by the selected one integrated source driver circuit 13, the gate control signal can be directly generated by the selected one integrated source driver circuit 13, or generated by the timing controller 17 and then delivered to the integrated gate driver circuit 14 through the selected one integrated source driver circuit 13.

Furthermore, the internal control signals generated by the internal control signal generation circuit 141 are not limited to include the foregoing internal gate output enable signal INTERNAL OE, internal gate start signal INTERNAL DIO_IN and internal shift clock pulse signal SF_CLK and can further include other similar internal control signal(s).

In summary, in the above-mentioned embodiments of the present invention, only one gate control signal is inputted into an integrated gate driver circuit and then a plurality of internal control signals would be generated according to the gate control signal by internal circuits of the integrated gate driver circuit to carry out the control of internal operations of the integrated gate driver circuit. Consequently, the amount of input pins of the integrated gate driver circuit relatively become less and the saved input pins can be used in other aspects. As a result, the revision cost caused by additional functional requirements incurring potential increase of input pins can be saved.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A control signal generation method of an integrated gate driver circuit, comprising:

externally providing one gate control signal to the integrated gate driver circuit; and internally generating a plurality of internal control signals according to the externally-provided gate control signal by the integrated gate driver circuit to control internal operations of the integrated gate driver circuit;

wherein the plurality of internal control signals comprise a first internal control signal, a second internal control signal and a third internal control signal, the first, the second and the third internal control signals respectively being an internal gate output enable signal, an internal gate start signal and an internal shift clock pulse signal; the internal gate start signal is for representing the start of a frame, the internal shift clock pulse signal is for enabling a gate line, and the internal gate output enable signal is for delaying or preceding the enable time of the gate line;

wherein the step of generating a plurality of internal control signals according to the gate control final by the integrated gate driver circuit to control the internal operations of the integrated gate driver circuit comprises:

performing an internal delay operation applied to the gate control signal to generate a delayed gate control signal;

performing an inverting operation applied to the delayed gate control signal to generate the first internal control signal of the internal control signals;

performing a low pass filter operation applied to the delayed gate control signal to generate the second internal control signal of the internal control signals; and performing a XOR logical operation applied to the delayed gate control signal and the second internal control signal to generate the third internal control signal of the internal control signals.

2. The control signal generation method as claimed in claim 1, wherein the integrated gate driver circuit is adapted to sequentially drive N (N>1) gate lines and the control signal generation method further comprises:

generating one external control signal according to an Nth gate pulse signal and the third internal control signal of the internal control signals by the integrated gate driver circuit, the external control signal being adapted to serve as one gate control signal of another integrated gate driver circuit electrically coupled to the integrated gate driver circuit in cascade.

3. The control signal generation method as claimed in claim 2, wherein the step of generating one external control signal according to the Nth gate pulse signal and the third internal control signal by the integrated gate driver circuit comprises:

using a falling edge of the third internal control signal as trigger and performing a data latch operation applied to the Nth gate pulse signal to generate a start signal; and performing an OR logical operation applied to the third internal control signal and the start signal to generate the external control signal.

4. An integrated gate driver circuit adapted to receive one external gate control signal, comprising:

an internal control signal generation circuit for generating a plurality of internal control signals according to the external gate control signal to control internal operations of the integrated gate driver circuit;

wherein the internal control signal generation circuit comprises:

a delay circuit having a first input terminal and a first output terminal, wherein the first input terminal is coupled to receive the external gate control signal;

an inverter circuit having a second input terminal and a second output terminal, wherein the second input terminal is electrically coupled to the first output terminal and the second output terminal is for outputting a first internal control signal of the internal control signals;

a low pass filter circuit having a third input terminal and a third output terminal, wherein the third input terminal is electrically coupled to the first output terminal and the third output terminal is for outputting a second internal control signal of the internal control signals; and a XOR logical gate having two fourth input terminals and a fourth output terminal, wherein the fourth input terminals respectively are electrically coupled to the first output terminal and the third output terminal, and the fourth output terminal is for outputting a third internal control signal of the internal control signals.

5. The integrated gate driver circuit as claimed in claim 4, wherein the first, the second and the third internal control signals respectively are an internal gate output enable signal, an internal gate start signal and an internal shift clock pulse signal.

6. The integrated gate driver circuit as claimed in claim 4, further comprising:

a gate pulse signal generation circuit for sequentially generating N (N>1) gate pulse signals subject to the control of at least a part of the internal control signals; and an external control signal generation circuit for generating one external control signal according to the Nth gate pulse signal and a special internal control signal of the internal control signals, wherein the external control signal is adapted to serve as one external gate control signal of another integrated gate driver circuit electrically coupled to the integrated gate driver circuit in cascade.

7. The integrated gate driver circuit as claimed in claim 6, wherein the external control signal generation circuit comprises:

a data latch having a fifth input terminal, a control terminal and a fifth output terminal, wherein the fifth input terminal is coupled to receive the Nth gate pulse signal, and the control terminal is coupled to receive the special internal control signal; and an OR logical gate having two sixth input terminals and a sixth output terminal, wherein the sixth input terminals respectively are electrically coupled to the fifth output terminal and the control terminal, and the sixth output terminal is for outputting the external control signal.

8. A liquid crystal display device comprising:

a first integrated gate driver circuit adapted to receive one external gate control signal and comprising:

an internal control signal generation circuit for internally generating a plurality of internal control signals according to the external gate control signal to control internal operations of the first integrated gate driver circuit, wherein the plurality of internal control signals comprise a first internal control signal, a second internal control signal and a third internal control signal, the first, the second and the third internal control signals respectively being an internal gate output enable signal, an internal gate start signal and an internal shift clock pulse signal;

a gate pulse signal generation circuit for sequentially generating N (N>1) gate pulse signals subject to the control of at least a part of the internal control signals; and an external control signal generation circuit for generating one external control signal according to the Nth gate pulse signal and the third internal control signal of the internal control signals; and a second integrated gate driver circuit electrically coupled to the first integrated gate driver circuit in cascade, the external control signal being adapted to input into the second integrated gate driver circuit as one external gate control signal of the second integrated gate driver circuit;

wherein the internal control signal generation circuit comprises:

a delay circuit having a first input terminal and a first output terminal, wherein the first input terminal is coupled to receive the external gate control signal;

an inverter circuit having a second input terminal and a second output terminal, wherein the second input terminal is electrically coupled to the first output terminal and the second output terminal is for outputting the first internal control signal of the internal control signals;

a low pass filter circuit having a third input terminal and a third output terminal, wherein the third input terminal is electrically coupled to the first output terminal and the third output terminal is for outputting the second internal control signal of the internal control signals; and a XOR logical gate having two fourth input terminals and a fourth output terminal, wherein the fourth input terminals respectively are electrically coupled to the first output terminal and the third output terminal, and the fourth output terminal is for outputting the third internal control signal of the internal control signals.

9. The liquid crystal display device as claimed in claim 8, further comprising a plurality of integrated source driver circuits one of which is selected to output the external gate control signal to the first integrated gate driver circuit.

10. The liquid crystal display device as claimed in claim 8, further comprising a timing controller adapted to output the external gate control signal to first integrated gate driver circuit.

11. The liquid crystal display device as claimed in claim 8, wherein the external control signal generation circuit comprises:

a data latch having a fifth input terminal, a control terminal and a fifth output terminal, wherein the fifth input terminal is coupled to receive the Nth gate pulse signal, and the control terminal is coupled to receive the third internal control signal; and an OR logical gate having two sixth input terminals and a sixth output terminal, wherein the sixth input terminals respectively are electrically coupled to the fifth output terminal and the control terminal, and the sixth output terminal is for outputting the external control signal.

* * * * *